US006327821B1

(12) United States Patent
Chang

(10) Patent No.: US 6,327,821 B1
(45) Date of Patent: Dec. 11, 2001

(54) STRUCTURE OF A FIRE-PROOF REFUGE SHELTER

(76) Inventor: Wen Fu Chang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/550,314

(22) Filed: Apr. 14, 2000

(51) Int. Cl.[7] ..... E04C 2/02
(52) U.S. Cl. ..... 52/79.1; 52/232
(58) Field of Search ..... 52/79.1, 232; 109/49.5, 109/86, 82, 84

(56) References Cited

U.S. PATENT DOCUMENTS 4,174,711 * 11/1979 Laing ..... 52/232 X
6,119,411 * 9/2000 Mateu Gil et al. ..... 52/232 X

FOREIGN PATENT DOCUMENTS

3735222 * 4/1989 (DE) ..... 52/232
1496516 * 12/1977 (GB) .
2067639 * 7/1981 (GB) ..... 52/232
2200666 * 8/1988 (GB) ..... 52/232
2-911367 * 9/1988 (JP) .

* cited by examiner

*Primary Examiner*—Richard Chilcot
(74) *Attorney, Agent, or Firm*—A & J

(57) ABSTRACT

A fire-proof refuge shelter includes a plurality of partition walls joined together by bolts and screws to form a closed box provided with a pair of sliding doors, characterized in that: each of the partition walls being made of a surface layer, an intermediate heat-resistant layer and an inner heat-resistant cement layer, the surface layer being made of fire-proof glass fiber or calcium silicate or mineral fiber, the inner heat resistant layer being a fire-proof sound absorbing board made of lightweight bone concrete or made by solidation of heat resistant concrete, and the intermediate heat resistant sand layer being made of non-combustible clay, silicon stone or substance primarily consisting of carbon, whereby oxygen tanks, flashlights and so on are arranged inside the shelter for people who waits for rescue.

1 Claim, 3 Drawing Sheets

STRUCTURE OF A FIRE-PROOF REFUGE SHELTER

BACKGROUND OF THE INVENTION

1. Field of the Invention

This invention is related to the structure of a fire-proof refuge shelter and in particular to one which can protect one from being injured by fire if he cannot escape through a window or a top ladder.

2. Description of the Prior Art

It is often known that many people die of suffocation and flames in a building, especially in a large and high building. In order to survive the toxic environment associated with fires, victims need to reach breathable air in minute. Hence, there are known fire alarms for used for giving warning signals to the people in a building. However, such alarms are simply apparatuses for giving a warning of a danger and cannot keep people from danger. Further, people may be too panic to properly operate fire escape equipment in case fire.

Therefore, it is an object of the present invention to provide a fire-proof refuge shelter which can protect people from danger in fire accidents.

SUMMARY OF THE INVENTION

This invention is related to the structure of a fire-proof refuge shelter and in particular to one which can protect one from being injured by fire if he cannot escape through a window or a top ladder.

It is the primary object of the present invention to provide a fire-proof refuge shelter which includes a plurality of partition walls joined together by bolts and screws to form a closed box provided with a pair of sliding doors, characterized in that: each of the partition walls being made of a surface layer, an intermediate heat-resistant layer and an inner heat-resistant cement layer, the surface layer being made of fire-proof glass fiber or calcium silicate or mineral fiber, the inner heat resistant layer being a fire-proof sound absorbing board made of lightweight bone concrete or made by solidation of heat resistant concrete, and the intermediate heat resistant sand layer being made of non-combustible clay, silicon stone or substance primarily consisting of carbon, whereby oxygen tanks, flashlights and so on are arranged inside the shelter for people who waits for rescue.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts. Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

Figure 1:
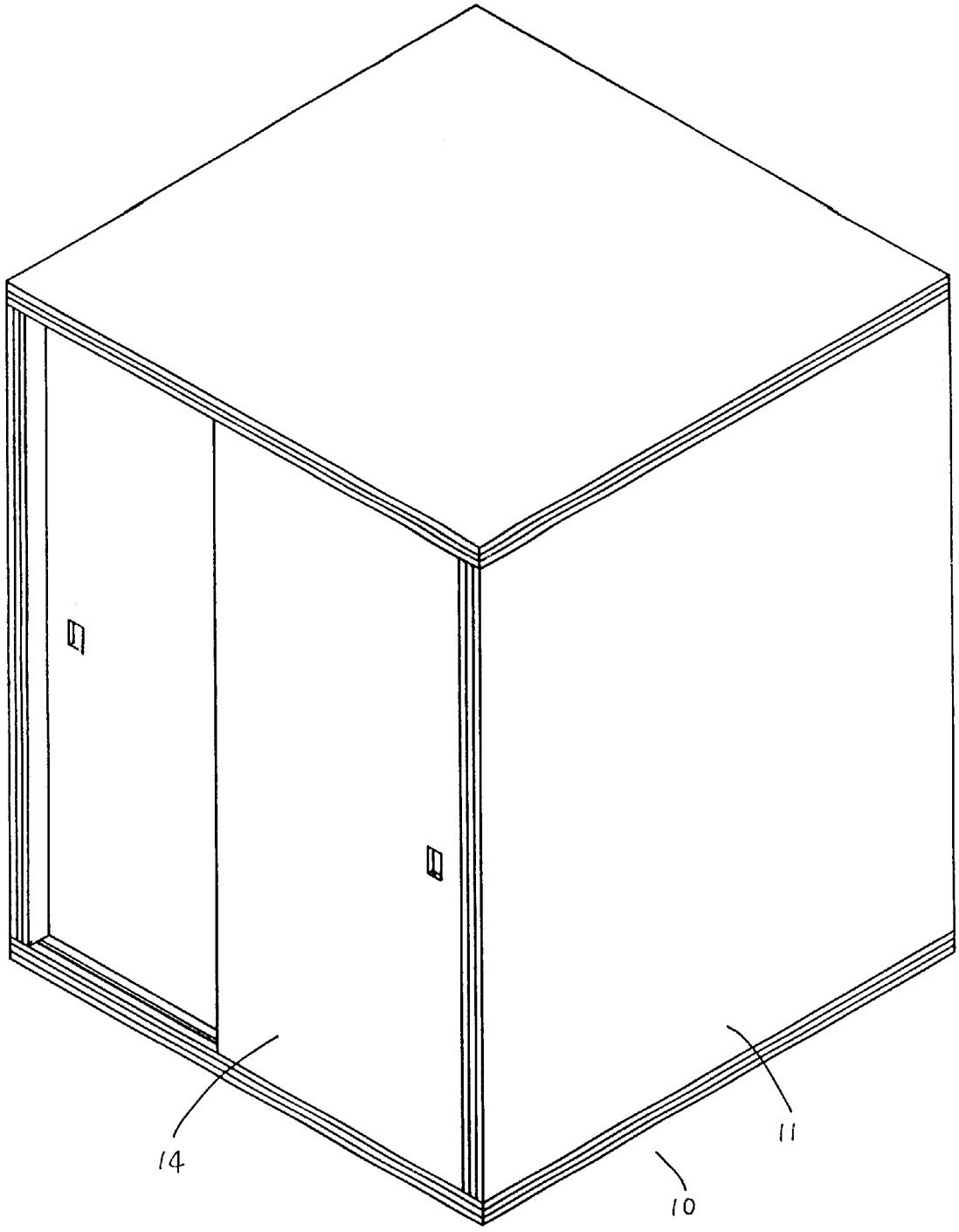
FIG. 1 is a perspective view of the present invention.

For the purpose of promoting an understanding of the principles of the invention, reference will now be made to the embodiment illustrated in the drawings. Specific language will be used to describe same. It will, nevertheless, be understood that no limitation of the scope of the invention is thereby intended, such alterations and further modifications in the illustrated device, and such further applications of the principles of the invention as illustrated herein being contemplated as would normally occur to one skilled in the art to which the invention relates.

Figure 2:
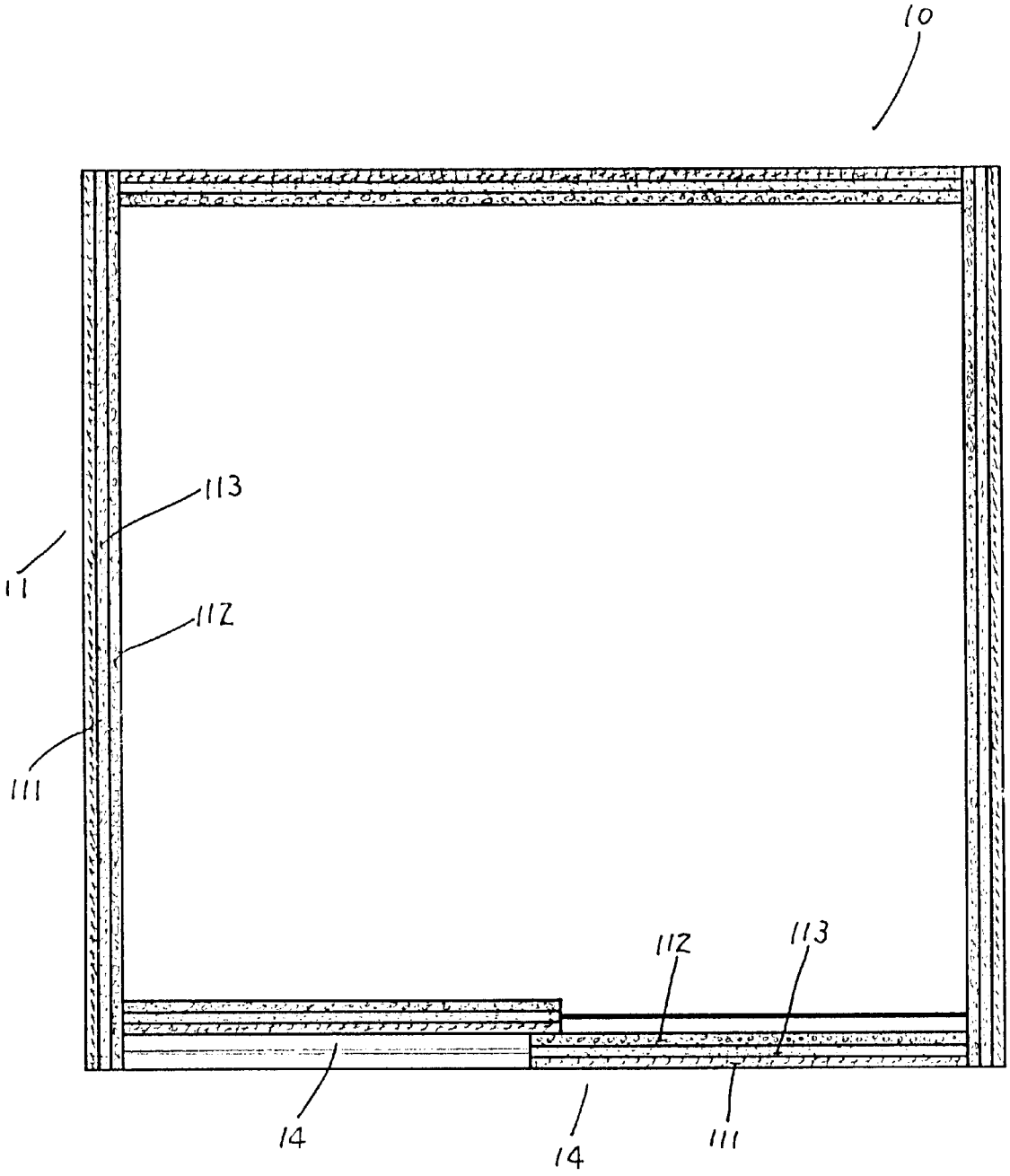
FIG. 2 is a sectional view of the present invention.
Figure 3:
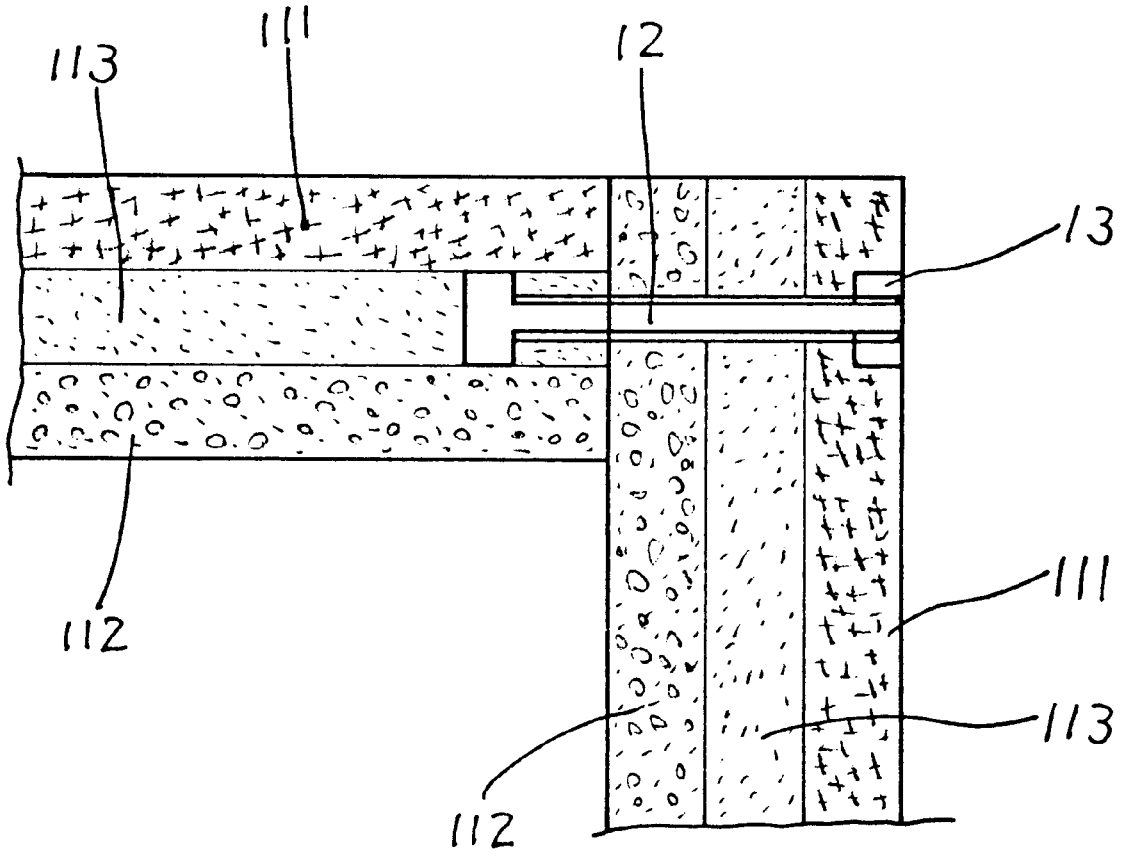
FIG. 3 is an enlarged fragmentary view of the present invention.

Referring to FIGS. 1, 2 and 3, the fire-proof refuge shelter according to the present invention comprises a plurality of partition walls 1 joined together by bolts 12 and nuts 13 to form a closed box 10 provided with a pair of sliding doors 14.

The partition wall 11 comprises a surface layer 111, an intermediate heat resistant sand layer 113, and an inner heat resistant cement layer 112. The surface layer 111, the intermediate layer 113 and the inner layer 112 are joined together by cement.

The surface layer 111 is made of fire-proof material such as fire-proof glass fiber or calcium silicate, or mineral fiber.

The inner heat resistant cement layer 112 may be a fire-proof sound absorbing board made of lightweight bone concrete or made by solidation of heat resistant concrete.

The intermediate heat resistant sand layer 113 may be made of non-combustible fire-proof clay or silicon stone or substance composed of carbon.

Further, oxygen tanks flashlights, . . . etc are arranged within the fire-proof refuge shelter, so that the people inside the shelter can be well protected against fire thereby making it fit for the safety of the people in high-rise buildings.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A fire-proof refuge shelter comprising a plurality of partition walls joined together by bolts and screws to form a closed box provided with a pair of sliding doors, wherein each of said partition walls is made of a surface layer, an intermediate heat-resistant layer and an inner heat-resistant cement layer, said surface layer being made of fire-proof glass fiber, said inner heat resistant layer being a fire-proof sound absorbing board made of lightweight concrete, and said intermediate heat resistant sand layer being made of non-combustible clay, whereby said shelter further comprises a means for holding a plurality of flashlights and a plurality of oxygen tanks inside said shelter.

* * * * *